US012098635B2

(12) United States Patent
Batarseh

(10) Patent No.: US 12,098,635 B2
(45) Date of Patent: Sep. 24, 2024

(54) WELLBORE DRILLING AND COMPLETION SYSTEMS USING LASER HEAD

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 122 days.

(21) Appl. No.: 17/845,287

(22) Filed: Jun. 21, 2022

(65) Prior Publication Data

US 2023/0407707 A1 Dec. 21, 2023

(51) Int. Cl.
*E21B 7/15* (2006.01)

(52) U.S. Cl.
CPC ..... *E21B 7/15* (2013.01)

(58) Field of Classification Search
CPC . E21B 7/14; E21B 7/143; E21B 7/146; E21B 7/15; E21B 43/281; E21B 43/285
See application file for complete search history.

(56) References Cited

U.S. PATENT DOCUMENTS 5,168,940 A * 12/1992 Foppe ..... E21B 25/10 175/11
6,755,262 B2 6/2004 Parker
8,464,794 B2 6/2013 Schulz et al.
8,636,085 B2 1/2014 Rinzler et al.
9,562,395 B2 2/2017 Grubb et al.
10,641,079 B2 5/2020 Aljubran et al.
11,913,303 B2 2/2024 Batarseh
2004/0195003 A1* 10/2004 Batarseh ..... E21B 33/138 175/16
2004/0244970 A1 12/2004 Smith, Jr.
2012/0074110 A1 3/2012 Zediker et al.
2012/0111578 A1* 5/2012 Tverlid ..... C09K 8/512 166/208
2014/0090846 A1 4/2014 Deutch et al.
2015/0233206 A1* 8/2015 Kocis ..... E21B 43/10 175/11
2017/0306703 A1* 10/2017 Samuel ..... E21B 44/00
2020/0115962 A1 4/2020 Batarseh

FOREIGN PATENT DOCUMENTS

CN 111379523 7/2020
WO WO 2019217176 11/2019

OTHER PUBLICATIONS

PCT International Search Report and Written Opinion in International Appln. No. PCT/US2023/025884, dated Aug. 30, 2023, 13 pages.
PCT International Search Report and Written Opinion in International Appln. No. PCT/US2023/025858, dated Aug. 25, 2023, 14 pages.

* cited by examiner

*Primary Examiner* — David Carroll
(74) *Attorney, Agent, or Firm* — Fish & Richardson P.C.

(57) ABSTRACT

Wellbore drilling and completion systems using a laser head implement methods of completing a wellbore. A wellbore drill bit is rotated through a subterranean zone to form a wellbore. Rotating the wellbore drill bit through the subterranean zone causes portions of the subterranean zone to be released as drill cuttings into the wellbore. A laser head, attached to the wellbore drill bit, emits a laser beam that is incident on a portion of the drill cuttings. The laser beam heats the portion of the drill cuttings to consolidate and form a casing of the wellbore.

16 Claims, 8 Drawing Sheets

WELLBORE DRILLING AND COMPLETION SYSTEMS USING LASER HEAD

TECHNICAL FIELD

This disclosure relates to forming and completing wellbores.

BACKGROUND

Hydrocarbons trapped in subsurface reservoirs can be raised to the surface of the Earth (that is, produced) through wellbores formed from the surface to the subsurface reservoirs. Wellbore drilling systems are used to drill wellbores through a subterranean zone (for example, a formation, a portion of a formation or multiple formations) to the subsurface reservoir. At a high level, the wellbore drilling system includes a drill bit connected to an end of a drill string. The drill string is rotated and weight is applied on the drill bit to drill through the subterranean zone. Wellbore drilling fluid (also known as drilling mud) is flowed in a downhole direction through the drill string. The drilling fluid exits the drill bit through ports defined in the drill bit and flows in an uphole direction through an annulus defined by an outer surface the drill string and an inner wall of the wellbore. As the drilling fluid flows towards the surface, it carries any cuttings and debris released into the wellbore due to and during the drilling. The cuttings and debris are released from the subterranean zone as the drill bit breaks the rock while penetrating the subterranean zone. When mixed with the drilling fluid, the cuttings and debris form a solid slurry that flows to the surface. At the surface, the cuttings and debris are filtered and the wellbore drilling fluid can be recirculated into the wellbore to continue drilling. The cuttings and debris carried to the surface by the drilling fluid provide useful information, among other things, about the wellbore being formed and the drilling process. As a wellbore is formed, portions of the wellbore are cased by lowering and installing a tubular into the wellbore.

SUMMARY

This specification describes technologies relating to wellbore drilling and completion systems using laser heads.

Certain aspects of the subject matter described here can be implemented as a method of completing a wellbore. A wellbore drill bit is rotated through a subterranean zone to form a wellbore. Rotating the wellbore drill bit through the subterranean zone causes portions of the subterranean zone to be released as drill cuttings into the wellbore. A laser head, attached to the wellbore drill bit, emits a laser beam that is incident on a portion of the drill cuttings. The laser beam heats the portion of the drill cuttings to consolidate and form a casing of the wellbore.

An aspect combinable with any other aspect includes the following features. The laser head is rotated with the wellbore drill bit while rotating the wellbore drill bit through the subterranean zone. Rotating the laser head heats the portion of the drill cuttings along an inner circumference of the wellbore.

An aspect combinable with any other aspect includes the following features. Emitting the laser beam on the portion of the drill cuttings causes the laser beam to push the portion of the drill cuttings towards an inner wall of the wellbore before the laser beam heats the portion of the drill cuttings to consolidate and form the casing of the wellbore.

An aspect combinable with any other aspect includes the following features. A nozzle is positioned near the wellbore drill bit. Filler material is discharged through the nozzle. The filler material is to be heated by the laser beam and to be consolidated with the portion of the drill cuttings to form the casing of the wellbore.

An aspect combinable with any other aspect includes the following features. The filler material is flowed from a surface of the wellbore to the nozzle.

An aspect combinable with any other aspect includes the following features. To emit the laser beam, a fiber-optic cable is guided from a surface of the wellbore to the laser head. The laser beam is transmitted from the surface through the fiber-optic cable.

An aspect combinable with any other aspect includes the following features. The fiber-optic cable is rotated together with the wellbore drill bit and the laser head.

An aspect combinable with any other aspect includes the following features. The laser head is mounted to be uphole relative to the wellbore drill bit.

An aspect combinable with any other aspect includes the following features. A separator member is mounted between the laser head and the wellbore drill bit. The separator member guides the drill cuttings towards a path of the laser beam.

Certain aspects of the subject matter described here can be implemented as a wellbore completion that includes a wellbore drill bit and a laser head. The wellbore drill bit is configured to rotate and drill through a subterranean zone to form a wellbore. While rotating and drilling through the subterranean zone, the wellbore drill bit is configured to release portions of the subterranean zone as drill cuttings into the wellbore. The laser head is attached to the wellbore drill bit. The laser head is configured to emit a laser beam that, when incident on a portion of the drill cuttings, heats the portion of the drill cuttings to consolidate and form a casing of the wellbore.

An aspect combinable with any other aspect includes the following features. The laser head is configured to rotate with the wellbore drill bit to heat drill cuttings along an inner circumference of the wellbore.

An aspect combinable with any other aspect includes the following features. The laser head is configured to emit the laser beam to push the portion of the drill cuttings towards an inner wall of the wellbore before being heated to consolidate and form the casing of the wellbore.

An aspect combinable with any other aspect includes the following features. Multiple nozzles are mounted to the laser head. The multiple nozzles are configured to flow filler materials to be heated by the laser beam and to be consolidated with the portion of the drill cuttings to form the casing of the wellbore.

An aspect combinable with any other aspect includes the following features. The completion includes a flow pathway from a surface of the wellbore to the multiple nozzles. The flow pathway is configured to flow the filler material from the surface of the wellbore.

An aspect combinable with any other aspect includes the following features. The completion includes multiple fiber-optic cables, each extending from a surface of the wellbore to the laser head, and each configured to transmit the laser beam from the surface of the wellbore.

An aspect combinable with any other aspect includes the following features. The laser head is mounted uphole relative to the wellbore drill bit.

An aspect combinable with any other aspect includes the following features. The completion includes a separator member mounted between the laser head and the wellbore drill bit. The separator member is configured to guide the drill cuttings towards a path of the laser beam.

An aspect combinable with any other aspect includes the following features. The separator member includes an adjustable arm and a curved plate, each of which is adjustable to direct the drill cuttings towards the path of the laser beam.

Certain aspects of the subject matter described here can be implemented as a method of completing a wellbore. A wellbore drilling assembly rotates a wellbore drill bit through a subterranean zone to form a wellbore. Rotating the wellbore drill bit through the subterranean zone causes portions of the subterranean zone to be released as drill cuttings into the wellbore. A laser head is attached to the wellbore drill bit. The laser head is configured to emit a laser beam. The laser beam emitted from the laser head pushes the drill cuttings towards an inner wall of the wellbore. The laser beam emitted from the laser head heats the drill cuttings pushed to the inner wall of the wellbore. The heating melts the drill cuttings and forms a casing on the inner wall of the wellbore.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
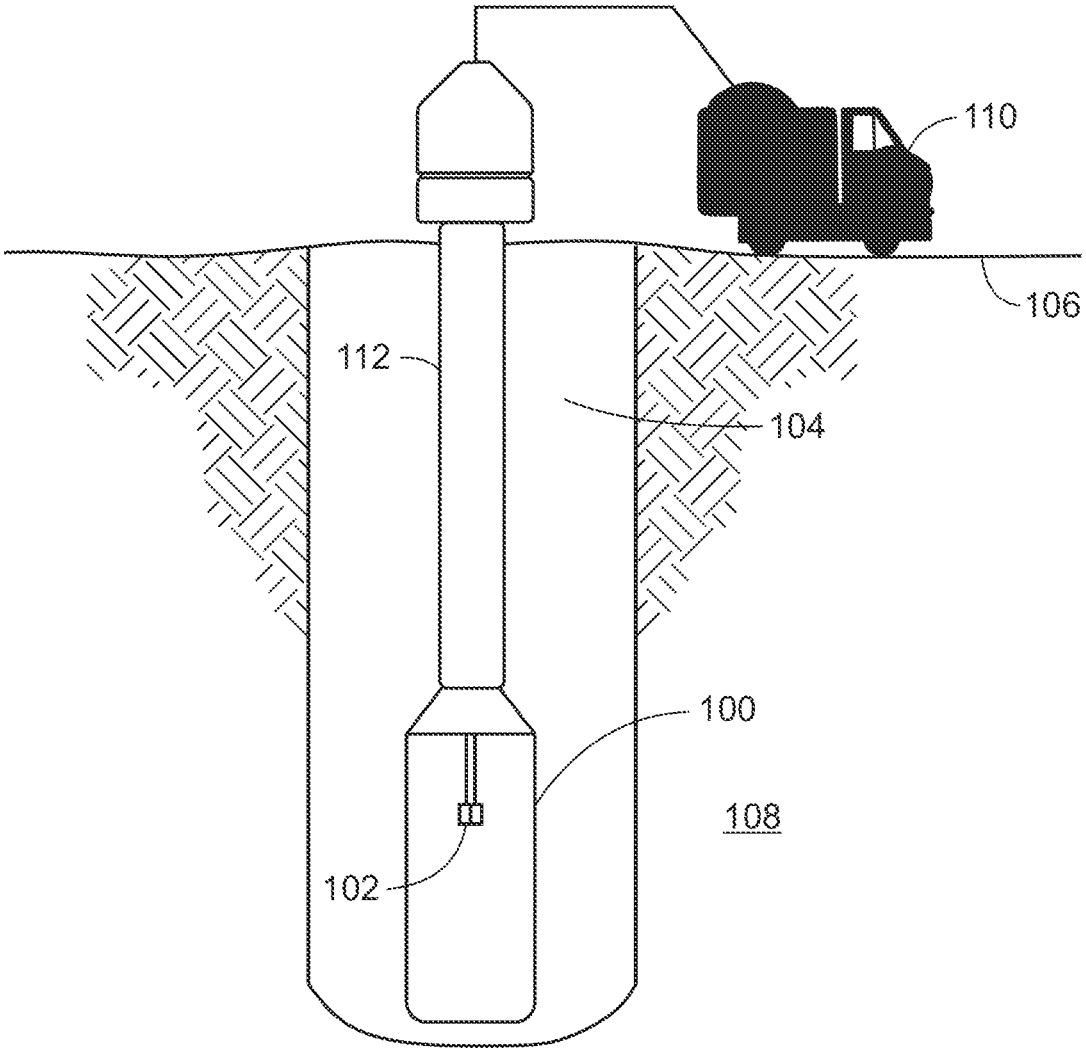
FIG. 1 is a schematic diagram of an example of a wellbore completion with a laser head-based wellbore drilling and completion system.

Drilling operations for oil and gas uses drilling rig to drill the wellbore, mud tanks to circulate the wellbore drilling fluid (also known as wellbore drilling mud or mud) and casing pipes to install the wellbore. The casing is used to maintain wellbore stability and prevent the collapsing and sanding. When the wellbore is drilled, large casing, which are called conductor casing, are first installed. Then, cement is pumped between the casing and the formation to form a cased wellbore. Then, drilling continues deeper, stops, and intermediate casing is installed. Once again, cement is pumped to cement between the formation and the cement, and the conductor casing and the intermediate casing. Another casing, which is the smallest casing, is installed with cement between the intermediate and the production casings. The casing aspect of conventional drilling operations can be time-consuming and resource intensive. To perform the casing operation, multiple casing pipes along with cement and mud are stored at the well site, occupying large surface footprint.

This disclosure describes using high-powered laser technology in conventional drilling operation to create casing while drilling. In some aspects, mechanical and rotary drilling is used to drill a wellbore through a subterranean zone, and a laser beam emitted from a laser head attached to the wellbore drill bit is used to consolidate drill cuttings to form a casing on an inner wall of the wellbore. In some aspects, a first laser beam is used to drill (or form) the wellbore in a downhole direction, while a second laser beam is used to consolidate drill cuttings to form a casing on an inner wall of the wellbore. In some aspects, the laser beam exerts a force on the drill cuttings to push the drill cuttings towards the inner wall of the wellbore. In some aspects, acoustic signals transmitted from an acoustic source exert the force on the drill cuttings to push the drill cuttings towards the inner wall of the wellbore. Additional aspects are described below.

Using a high power laser, either alone or in combination with mechanical rotary drilling, to perform casing while drilling will eliminate the need of large investment in casing materials, cement and time used for casing. The techniques described here apply high-powered lasers, which are attractive to the oil and gas industry due to the unique properties of lasers such as precision, reliability, control and cost. For example, the techniques described in this disclosure utilize a laser's ability to rapidly increase the temperature of rocks and sand (for example, sandstone) to as high as 2000° C. as quickly as in three seconds. In addition, the techniques described here can reduce the equipment footprint needed to form a wellbore by eliminating the need for large-footprint drilling equipment in favor of comparatively smaller-footprint equipment such as laser generators and chillers, which can be mounted on a coiled tubing unit and a trailer. Laser is a multifunctional tool that can be used for several operations. The same laser energy source can be used from the drilling to producing the well by only changing the tool. The ability to do so plays a significant role in attaining net-zero targets.

FIG. 1 is a schematic diagram of a wellbore completion 100 with a laser head-based wellbore drilling and completion system 102. The wellbore 104 can extend from the surface 106 through the Earth to one or more subterranean zones of interest 108. The wellbore completion 100 includes a surface unit 110 positioned above the surface 106 to lower the wellbore completion 100 through the wellbore 104 and to control the operation of the wellbore drilling and completion system 102, as described below. The surface unit 110 can include a laser source (shown later), and can lower a fiber-optic cable 112 connected to the laser source. The wellbore completion 100 includes additional components such as a wellhead, a drill string assembly supported by a rig structure, and a fluid circulation system to filter used drilling fluid from the wellbore and provide clean drilling fluid to the drill string assembly (not shown).

As described below, in some implementations, the wellbore completion 100 can form a wellbore with a combination of a conventional wellbore drilling assembly that includes a wellbore drill bit and a laser beam. In some implementations, the wellbore completion 100 can form a wellbore with a combination of two laser beams emitted by the same laser source or respective laser sources. In all implementations described in this disclosure, the laser beam is used to melt and consolidate drill cuttings to an inner wall of the wellbore 104 to form a casing. The interaction between the laser beam and the drill cuttings causes a phase change in the drill cuttings due to an increase in temperature. Different temperature levels to which the laser increases the temperature of the drill cuttings will have different effect on the drill cuttings themselves. The laser source can be selected based on the ability of the laser beam to increase the temperature of the drill cuttings two different temperature levels. In turn, the different temperature levels can be selected based on the rock type of the subterranean zone in which the wellbore 104 being drilled. For example, sandstone melt set about 1400° C., while limestone dissociates at about 1100° C. Subterranean rock spalls (i.e., breaks into small fragments) around 400° C., and clay collapses at temperatures ranging between 300° C. and 570° C. The laser beam emitted by the laser source can be tuned to deliver power that allows the temperature to reach the melting point of the drill cuttings.

Figure 2:
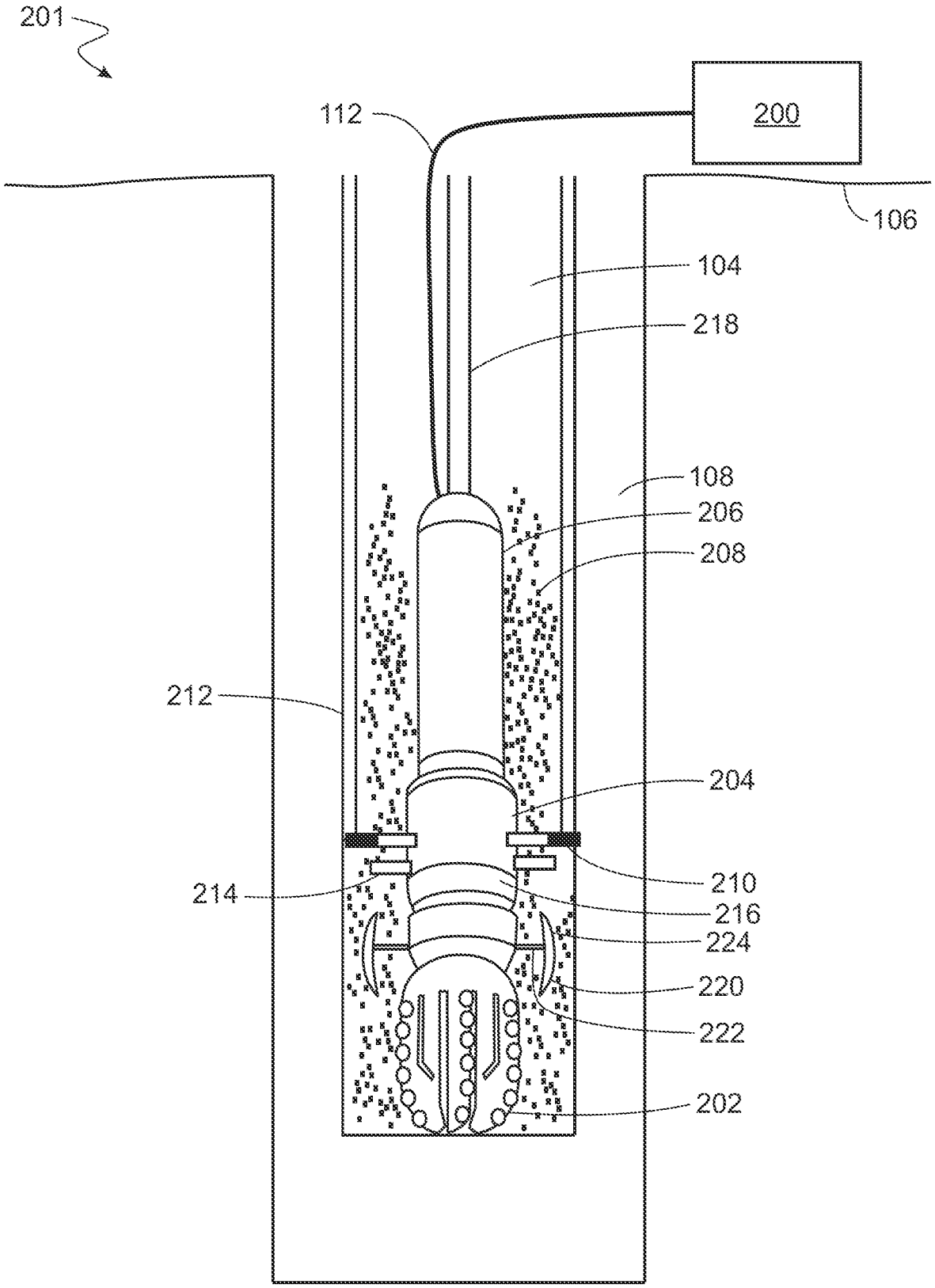
FIG. 2 is a schematic diagram of an example of a wellbore completion that combines a wellbore drill bit and a laser head.

FIG. 2 is a schematic diagram of a wellbore completion 201 that combines a wellbore drill bit 202 and a laser head 204, both of which are mounted to an end of a drill string 206 configured to rotate and drill through the subterranean zone to form the wellbore 104. While rotating and drilling through the subterranean zone, the wellbore drill bit 202 releases portions of the subterranean zone as the drill cuttings 208 into the wellbore 104. As shown in FIG. 2, the laser head 204 is attached to the wellbore drill bit 202. The laser head 204 can emit a laser beam 210. When the laser beam 210 is incident on a portion of the drill cuttings 208, the laser beam 210 heats the portion of the drill cuttings 208 to consolidate and form a casing 212 of the wellbore 104.

In some implementations, the laser head 204 is configured to rotate with the wellbore drill bit 202 to heat the drill cuttings 208 along an inner circumference of the wellbore 104. That is, the laser beam 210 emitted by the laser head 204 heats all the drill cuttings 208 encountered by the laser beam 210 from the laser head 204 to the inner wall of the wellbore 104. Because the laser head 204 rotates, the laser beam 210 follows a substantially circular path defining the inner circumference of the wellbore 104. All the drill cuttings 208 that the laser beam 210 contacts while following the substantially circular path will get heated. In addition to heating the drill cuttings 208, the laser beam 210 also pushes the drill cuttings 208 towards the inner wall of the wellbore 104. As the drill cuttings 208 are pushed to the inner wall of the wellbore 104 and heated, the drill cuttings 208 melt and consolidate, and, upon cooling, solidify to form the casing 212 on the inner wall of the wellbore 104.

The fiber-optic cable 112 is connected to the laser head 204 on one end and, at the end other, to a laser source 200 positioned on the surface 106. In some implementations, the laser source 200 can be positioned inside the surface unit 110. In some implementations, the laser source 200 emits a Ytterbium fiber laser or other type of high-power laser beam with power sufficient to heat and melt the drill cuttings 208. The wellbore completion 201 includes a fiber optics feed through which the fiber-optic cable 112 passes from the laser source 200 to the laser head 204.

Figure 3:
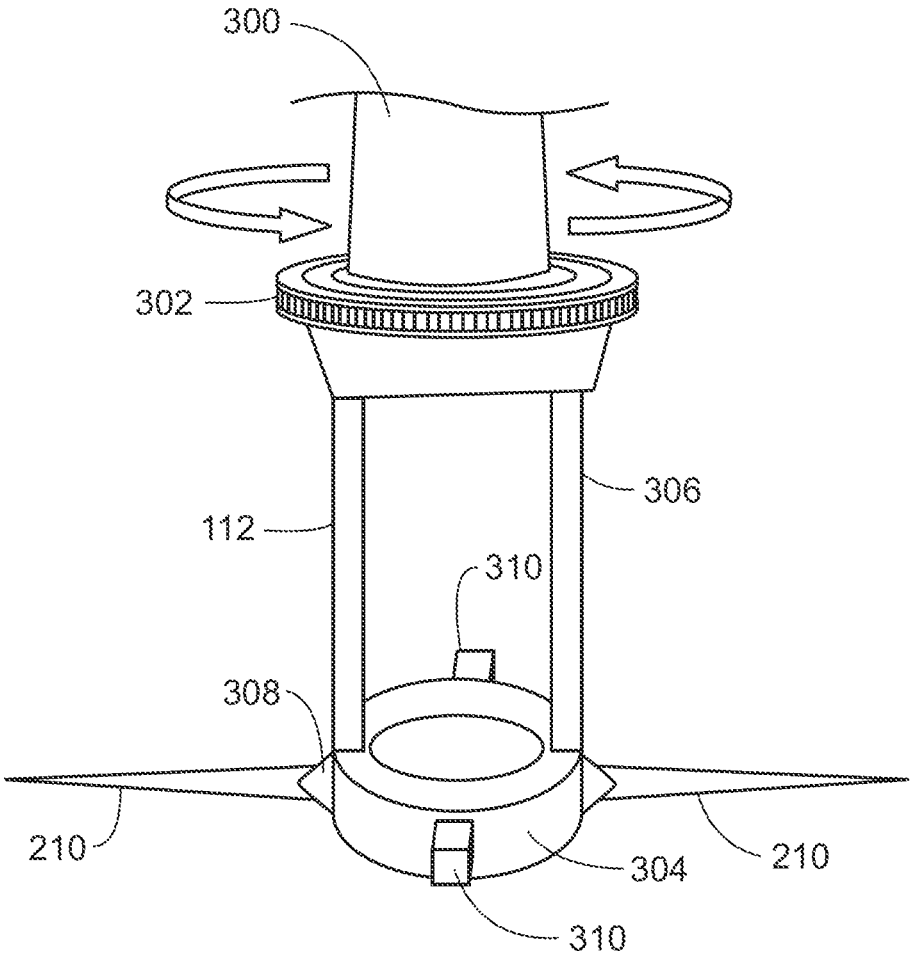
FIG. 3 is a schematic diagram of an example of a fiber optics feed to transmit a laser beam to the wellbore completion of FIG. 2.

FIG. 3 is a schematic diagram of an example of a fiber optics feed 300. In some implementations, the fiber optics feed 300 is connected to the laser head 204, which is configured to rotate with the wellbore drill bit. The laser head 204 includes a rotational member 302 configured to be mounted to and rotate with the drill string 206 (FIG. 1). The laser head 204 also includes a ring member 304 that is mounted to the drill string 206 (FIG. 2). The ring member 304 and the rotational member 302 are configured to rotate together with the drill string 206 (FIG. 2). The fiber-optic cable 112 extends from the surface 106 to the fiber optics feed 300, specifically through the rotational member 302, and extends to the ring member 304. In some implementations, a second fiber-optic cable 306 (or more fiber-optic cables) can be routed from the surface 106 to the laser head 204.

In some implementations, the ring member 304 defines one or more openings 308 through which the laser beam 210, transmitted through the fiber-optic cable 112, exits the ring member 304 to be emitted into the wellbore 104 (FIG. 1). The ring member 304 can include optical components (e.g., lenses, mirrors, similar optical components) to change the path of (and additionally focus or collimate or otherwise manipulate) the laser beam 210 from an axial direction with respect to a longitudinal axis of the wellbore 104 to a radial direction with respect to the longitudinal axis. The rotation of the fiber optics feed 300 with the drill string 206 (FIG. 2) combined with the emission of the laser beam 210 through the openings 308 generates a radial laser beam that is incident upon the drill cuttings released from the subterranean zone when the wellbore drill bit drills through the subterranean zone.

The ability of the drill cuttings to melt and consolidate to form the casing of the wellbore 104 depends, in part, on the rock type of the subterranean zone. For example, rocks with quartz can form a casing while drilling. In some implementations, certain other types of rocks (e.g., carbonate with low quartz content), on the other hand, can be combined with filler materials 214 to form the casing, as described with reference to FIG. 2.

As shown in FIGS. 2 and 3, in some implementations, the ring member 304 (FIG. 3) can define multiple nozzles 310, which are configured to flow filler material 214 into the wellbore 104. The filler material 214 can include sand grains, iron powder, other minerals or any combination of materials which, when heated and melted with the drill cuttings, forms strong casing upon cooling and solidification. In some implementations, the filler material 214 is pumped into the wellbore 104 from the surface, e.g., through a flow pathway 218. In some implementations, the filler material 214 is stored in a storage container 216 attached to the drill string 206 and lowered into the wellbore 104. In some implementations, the filler material 214 can be pumped through the flow pathway 218 into the storage container 216. During operation, the filler material 214 can be flowed through the nozzles 310 into the wellbore 104. The filler material 214 mixes with the drill cuttings 208, and the resulting mixture is pushed toward the inner wall of the wellbore 104 by the laser beam 210. The laser beam 210 heats the mixture, which consolidates to form the casing 212 of the wellbore 104.

As shown in FIG. 2, the laser head 204 is mounted uphole relative to the wellbore drill bit 202. In some implementations, a separator member 220 (e.g., a separator packer) is mounted between the laser head 204 and the wellbore drill bit 202. The separator member 220 is configured to guide the drill cuttings 208 towards a path of the laser beam 210. To do so, the separator member includes an adjustable arm 222 and a curved plate 224. One end of the adjustable arm 222 is attached to the separator member 220, which is positioned downhole relative to the nozzles 310 through which the filler material 214 is flowed into the wellbore 104. In addition, the adjustable arm 222 is positioned uphole relative to the drill bit 202. The other end of the adjustable arm 222 is attached to a center of the curved plate 224 in a hinged manner that allows the curved plate to pivot about the adjustable arm 222. The curved plate 224 has a curvature. During operation, when the drill cuttings 208 are released in the vicinity of the drill bit 202, the position of the adjustable arm 222 is adjusted to orient the curved plate to 24 so as to receive a portion of the drill cuttings 208 and guide the received portion towards the laser beam 210. The adjustable arm 222 can be controlled from the surface. For example, a downhole camera or other sensor can be used to see and sense the intensity of the rock being separated from the subterranean zone. Based on the sensed inputs, the adjustable arms can be moved to control the volume of the drill cuttings being directed towards the laser beam.

Figure 4:
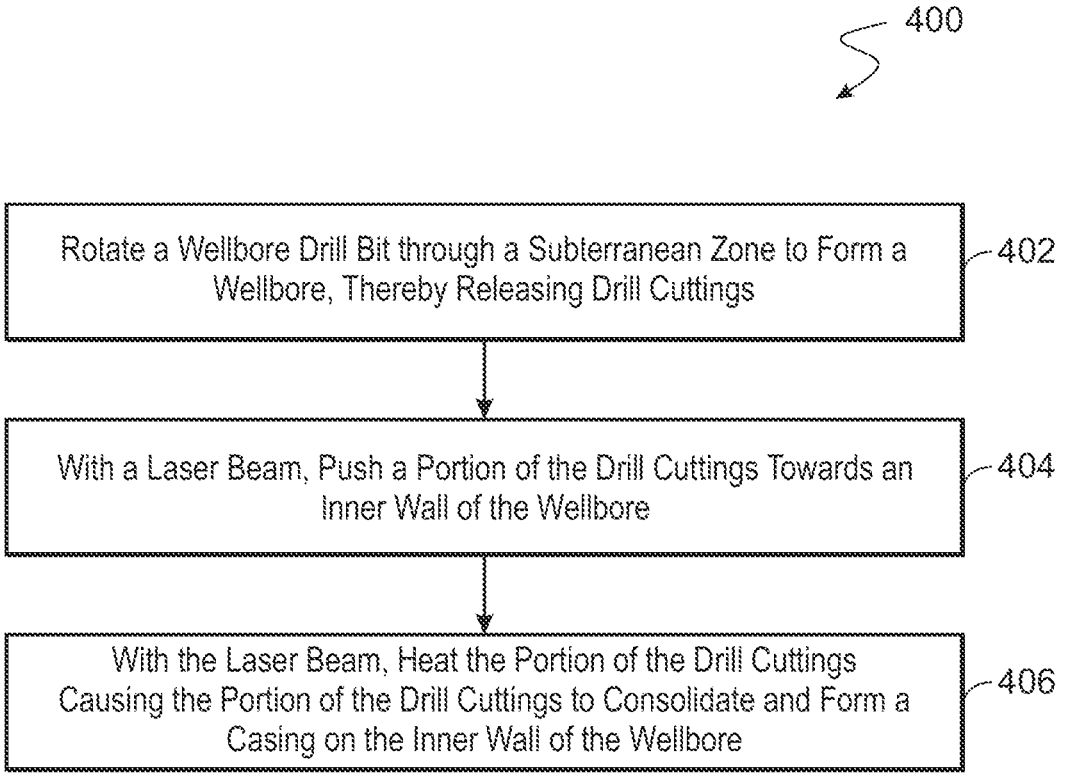
FIG. 4 is a flowchart of an example of a process of completing a wellbore with a laser head-based wellbore drilling and completion system.

FIG. 4 is a flowchart of an example of a process 400 of completing a wellbore with a laser head-based wellbore drilling and completion system. At 402, a wellbore drill bit, e.g., the wellbore drill bit 202, is rotated through a subterranean zone to form a wellbore, e.g., the wellbore 104. Rotating the wellbore drill bit through the subterranean zone causes portions of the subterranean zone to be released as drill cuttings, e.g., the drill cuttings 208, into the wellbore. At 404, a portion of the drill cuttings is pushed towards an inner wall of the wellbore with a laser beam, e.g., the laser beam 210. At 408, the portion of the drill cuttings is heated with the laser beam causing the portion of the drill cuttings to consolidate and form a casing on the inner wall of the wellbore.

As described above, the hybrid bit (i.e., the wellbore drill bit 202 with the laser head 204) will have the fiber-optic cable 112 during the rotational drilling through the subterranean zone. While the wellbore drill bit 202 is rotating and removing materials from the subterranean zone to form the drill cuttings 208, the laser beam 210 is turned on to emit a controlled beam that travels the inner circumference of the wellbore. In some implementations, a wellbore drilling fluid is also circulated. The wellbore drilling fluid can be a special optical fluid (e.g., a halocarbon or similar fluid) that allows the laser beam 210 to travel through while also carrying the drill cuttings 208 to the surface 106. The separator member 220 guides a part of the drill cuttings 208 towards the laser beam 210, which pushes the drill cuttings 208 towards the inner wall of the wellbore 104 while heating and melting the drill cuttings 208 to form the casing on the inner wall of the wellbore 104. To push the drill cuttings 208 towards the inner wall of the wellbore 104, the laser head 204 can include purging nozzles that can flow gas or fluid that pushes the drill cuttings 208 towards the wall of the wellbore 104. In some implementations, the laser head 204 can also include cooling nozzles (not shown) that can flow a cooling agent (e.g., a gas or fluid) to cool down the heated drill cuttings or the filler material or both to aid in consolidation and solidification. The wellbore drill bit 202 is continued to be lowered into the subterranean zone as the wellbore 104 becomes deeper. The mud flows any drill cuttings 208 that are not consolidated to the surface 106 of the wellbore 104.

Figure 5:
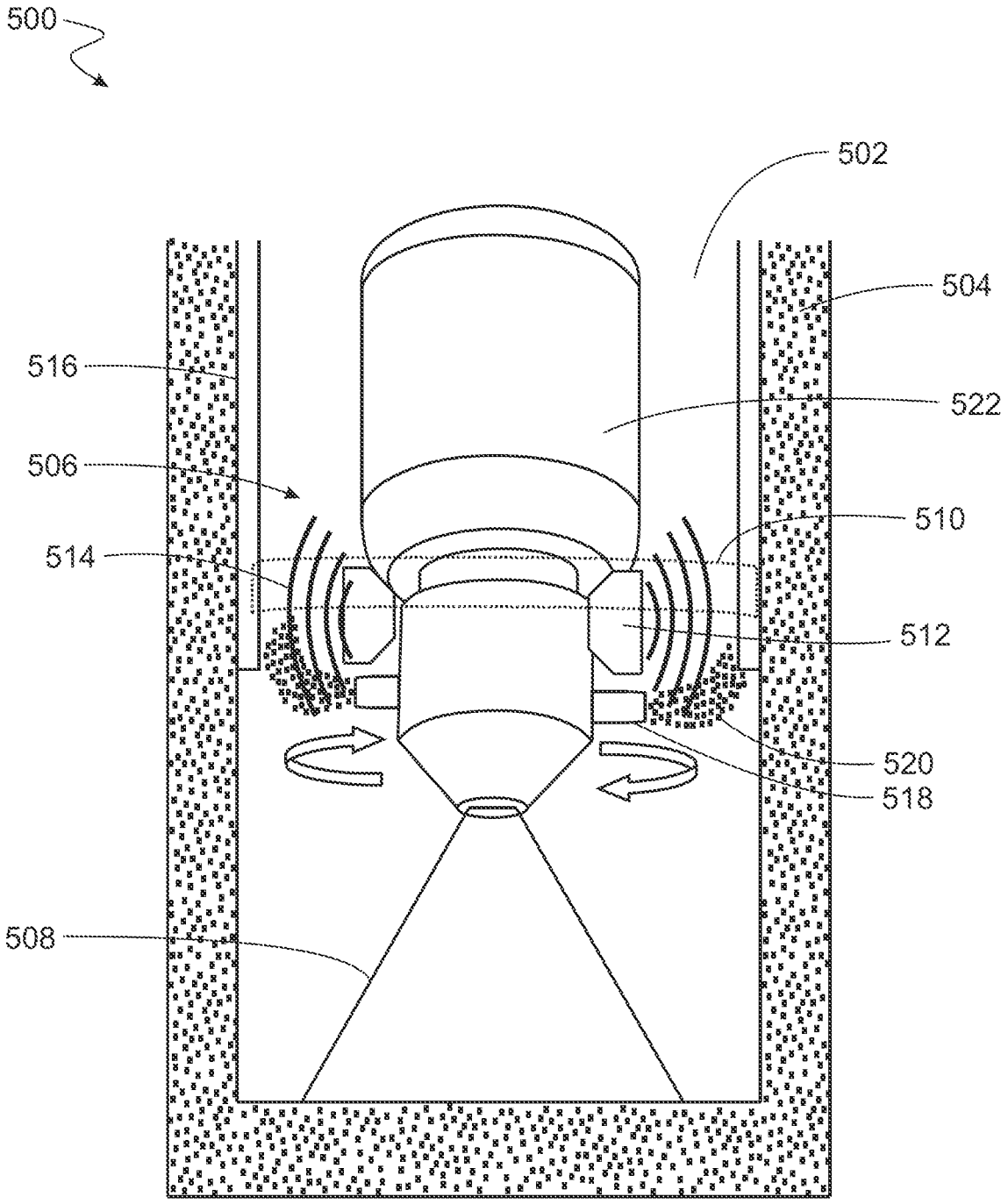
FIG. 5 is a schematic diagram of an example of a wellbore completion that emits two laser beams.

FIG. 5 is a schematic diagram of an example of a wellbore completion 500 that emits two laser beams. The wellbore completion 500 a wellbore drilling assembly configured to form a wellbore 502 (similar to the wellbore 104) through a subterranean zone 504. The wellbore drilling assembly includes a laser head 506 that can generate two laser beams—a first laser beam 508 emitted in a downhole direction within the wellbore 502; a second laser beam 510 emitted in a radial direction within the wellbore 502. The first laser beam 508 causes portions of the subterranean zone 504 to be released as drill cuttings (similar to the drill cuttings 208) into the wellbore 502. The second laser beam 510, when incident on a portion of the drill cuttings, causes the portion of the drill cuttings to consolidate and form a casing of the wellbore 502, in a manner similar to that described with reference to FIGS. 2-4.

In operation, the wellbore completion 500 rotates within the wellbore 502 while being lowered in the downhole direction within the wellbore 502. The first laser beam 508 heats the rock in the subterranean zone 504 to temperatures that cause the rock spalls and be released from the subterranean zone 504 as drill cuttings. In some implementations, the first laser beam 508 has a conical profile, where a diameter of the base of the conical profile is at least as large as an inner diameter of the wellbore 502 to be formed through the subterranean zone 504. Wellbore drilling mud or other fluids can be flowed through the wellbore 502 while the first laser beam 508 heats and spalls the rock in the subterranean zone 504. As the wellbore drilling mud caddies the drill cuttings in an uphole direction towards a surface of the wellbore 502, the second laser beam 510 is incident on the drill cuttings. The second laser beam 510 can have a ring profile, as shown in FIG. 6, push the drill cuttings towards an inner wall of the wellbore 502, and to heat and consolidate the drill cuttings on the inner wall of the wellbore 502 to form a casing 516 of the wellbore 502.

In some implementations, the laser head 506 is configured to rotate with the wellbore drill bit 202 to heat the drill cuttings 208 along an inner circumference of the wellbore 104. That is, the laser beam 210 emitted by the laser head 204 heats all the drill cuttings 208 encountered by the laser beam 210 from the laser head 204 to the inner wall of the wellbore 104. Because the laser head 204 rotates, the laser beam 210 follows a substantially circular path defining the inner circumference of the wellbore 104. All the drill cuttings 208 that the laser beam 210 contacts while following the substantially circular path will get heated. In addition to heating the drill cuttings 208, the laser beam 210 also pushes the drill cuttings 2082 words the inner wall of the wellbore 104. As the drill cuttings 208 are pushed to the inner wall of the wellbore 104 and heated, the drill cuttings 208 melt and consolidate to form the casing 212 on the inner wall of the wellbore 104.

Figure 6:
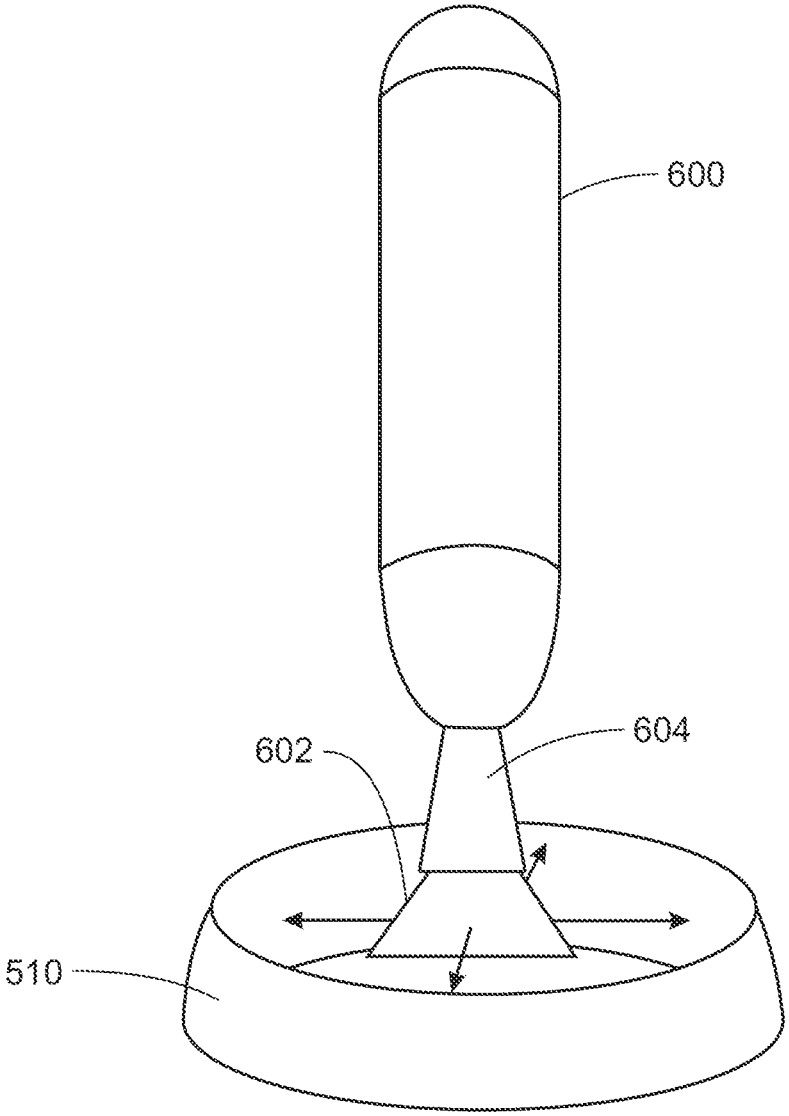
FIG. 6 is a schematic diagram of an example of a ring-profiled laser beam emitted by the wellbore completion of FIG. 5.

FIG. 6 is a schematic diagram of an example of a ring-profiled laser beam 510 emitted by the wellbore completion of FIG. 5. Similar to the laser source 200 (FIG. 2), the wellbore completion 500 can include a laser source (not shown) positioned at a surface of the wellbore 502. A fiber-optic cable 600 is connected to the laser head 506 on one end and, at the end other, to the laser source positioned on the surface of the wellbore 502. The laser source emits a Ytterbium fiber laser or other type of high-power laser beam 604 with power sufficient to heat and melt the drill cuttings. The wellbore completion 500 includes a fiber optics feed through which the fiber-optic cable 602 passes from the laser source to the laser head 506. In some implementations, the fiber optics feed includes a casing or sheet through which the fiber-optic cable 600 is done from the surface of the wellbore 502 to the laser head 506. The fiber optics feed additionally includes optical components 602 (e.g., optical cones, optical mirrors, optical lenses, similar equipment or any combinations of them) mounted on the laser head 506. The laser beam 604 exits the fiber-optic cable 600 and enters the optical components 600 and to, which both change a direction of the laser beam 604 from axial along a longitudinal axis of the wellbore 502 to radial along the longitudinal axis, and also convert a profile of the laser beam 604 into a ring-profile of the second laser beam 510. Drill cuttings that flow into the path of the ring-profile of the second laser beam 510 are heated, melted and consolidated to form the casing 516 of the wellbore 500 and to.

Returning to FIG. 5, in some implementations, the wellbore completion 500 includes an acoustic source 512 mounted to the wellbore drilling assembly. The acoustic source 512 is configured to transmit acoustic signals 514 to acoustically guide the drill cuttings towards the inner wall of the wellbore 502. The acoustic source 512 can operate at the same time that the laser head 506 emits the first laser beam 508 and the second laser beam 510. For example, the acoustic source 512 can be mounted on the wellbore completion 500 between the first laser beam 508 and the second laser beam 510. The acoustic source 512 can be arranged such that the acoustic signals 514 push the drill cuttings both in an uphole direction as well as in a radial direction such that the drill cuttings are forced to encounter the second laser beam 510. In some implementations, the acoustic source 512 can be arranged such that the acoustic signals 514 push the drill cuttings only in the radial direction, with a force to push the drill cuttings in the uphole direction being provided by the drilling mud flowed through the wellbore 502.

In some implementations, the wellbore completion 500 can define multiple nozzles 518 (similar to the nozzles 310 (FIG. 3)), which are configured to flow filler material 520 (similar to the filler material 214 (FIG. 2)) into the wellbore 502. The filler material 520 can include sand grains, iron powder, other minerals or any combination of materials which, when heated and melted with the drill cuttings, forms strong casing. In some implementations, the filler material 520 is pumped into the wellbore 502 from the surface, e.g., through a flow pathway similar to the flow pathway 218 (FIG. 2). In some implementations, the filler material 520 is stored in a storage container 522 similar to the storage container 216 (FIG. 2) attached to the drill string and lowered into the wellbore 502. During operation, the filler material 520 can be flowed through the nozzles 518 into the wellbore 502. The filler material 520 mixes with the drill cuttings, and the resulting mixture is pushed toward the inner wall of the wellbore 502 by the laser beam 510. The laser beam 510 heats the mixture, which consolidates to form the casing 516 of the wellbore 502.

Figure 7:
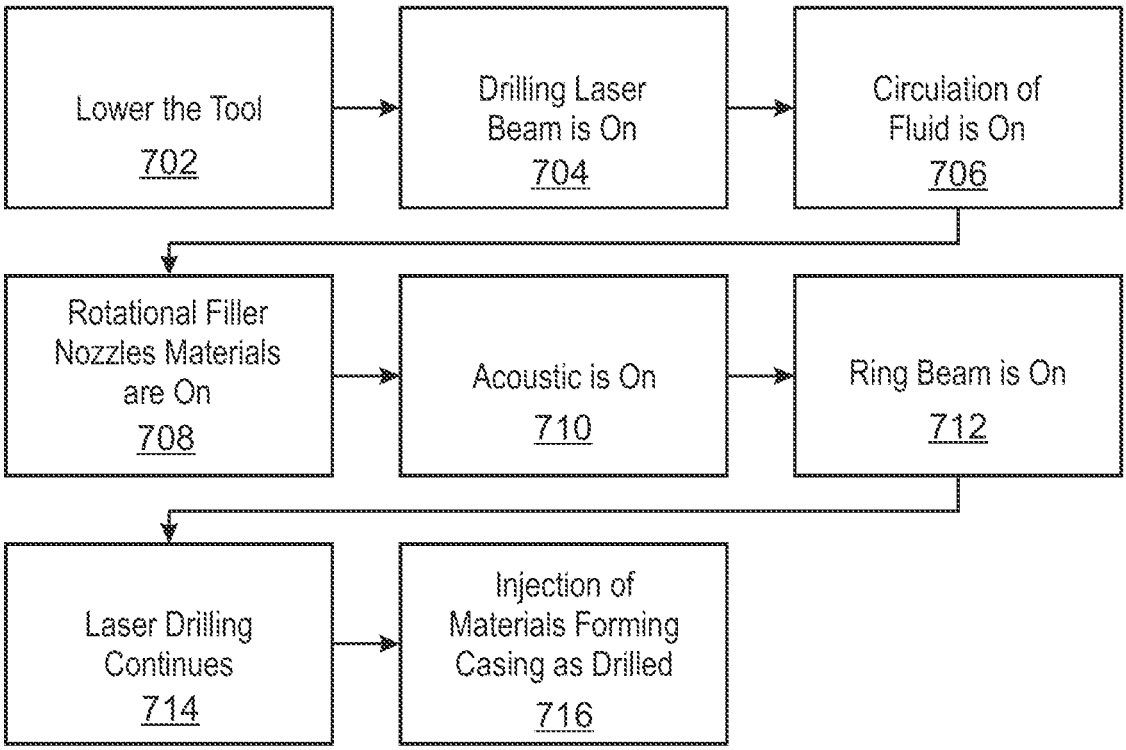
FIG. 7 is a workflow of an example of a process of operating the wellbore completion of FIG. 5.

FIG. 7 is a workflow of an example of a process of operating the wellbore completion of FIG. 5. At 702, a wellbore tool that includes wellbore completion 500 is lowered into the wellbore 502. The wellbore tool targets the subterranean zone 504 to be drilled and cased. At 704, the first laser beam 508 is turned on. The conical shape of the first laser beam 508 sheets and spalls lock in the subterranean zone 504, thereby releasing pieces of the rock as drill cuttings. It power as the first laser beam 508 can be tuned to provide sufficient power to increase the temperature of the rock beyond the rocks melting temperature to achieve drilling by sublimation. At 706, circulation of the wellbore drilling mud is turned on. In some implementations, optical fluid (e.g., halocarbon fluid) is used in place of or in addition to the wellbore drilling mud in a manner similar to that described earlier.

At 708, the nozzles 518 are turned on to inject filler material 520 into the wellbore 504. To push the drill cuttings towards the inner wall of the wellbore 502, the laser head 506 can include purging nozzles that can flow gas or fluid that pushes the drill cuttings towards the wall of the wellbore 502. In some implementations, the laser head 506 can also include cooling nozzles (not shown) that can flow a cooling agent (e.g., a gas or fluid) to cool down the heated drill cuttings or the filler material or both to aid in consolidation and solidification. At 710, the acoustic source 512 is turned on to transmit the acoustic wave 514 to guide the drill cuttings and the filler materials 520 towards the inner wall of the wellbore 502. At 712, the second laser beam 510 is turned on. As described earlier, the second laser beam 510 has a ring profile that is incident on the drill cuttings and the filler materials that have been guided towards the inner wall of the wellbore 502 by the acoustic wave 514. The second laser beam 510 heats the drill cuttings and the filler materials causing the mixture to melt, consolidate and solidify, thereby forming the casing on the inner wall of the wellbore 502. At 714, the laser drilling described in step 702 to 712 continues, with the wellbore completion 500 being lowered into the wellbore 500 and to as the wellbore 502 is being formed. At 716, the injection of filler materials 520 continues to form casing while drilling. The wellbore completion 500 is continued to be lowered into the subterranean zone 504 as the wellbore 502 becomes deeper. The mud flows any drill cuttings that are not consolidated to the surface of the wellbore 502.

Figure 8:
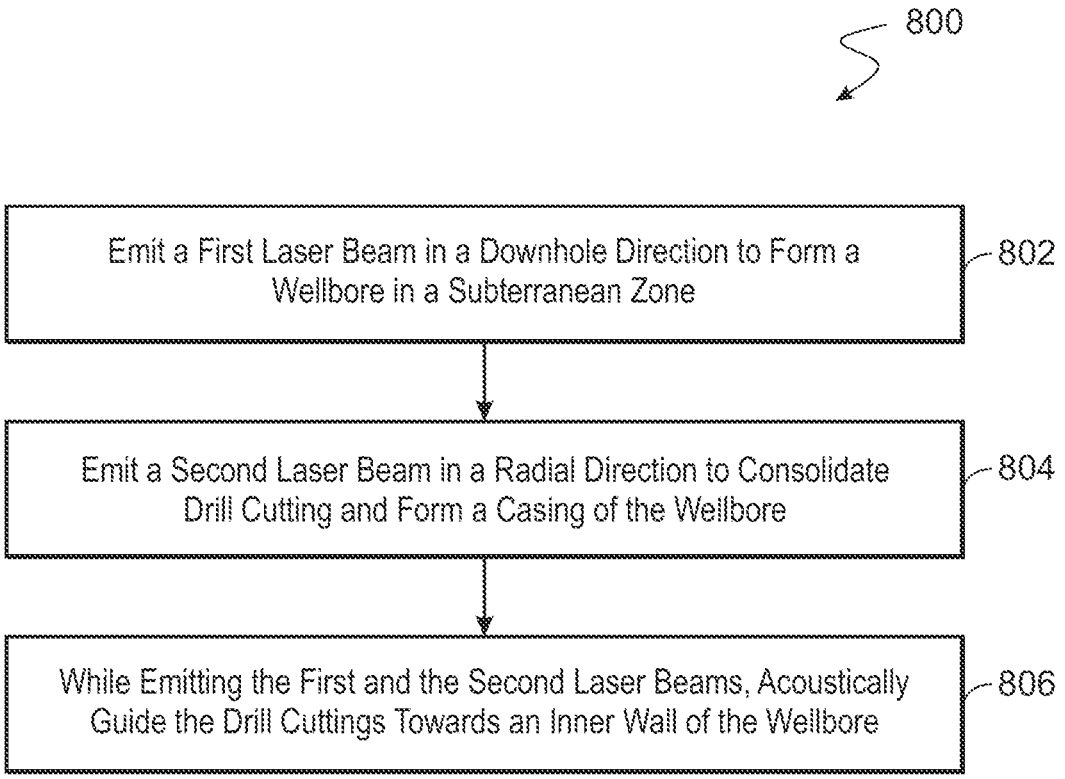
FIG. 8 is a flowchart of an example of a process of completing a wellbore with a laser head that emits two laser beams.

FIG. 8 is a flowchart of an example of a process 800 of completing a wellbore with a laser head that emits two laser beams. At 802, a laser head emits a first laser beam. The laser head is mounted to a wellbore drilling assembly positioned within a wellbore formed in a subterranean zone. The first laser beam is emitted in a downhole direction in the wellbore causing portions of the subterranean zone to be released as drill cuttings into the wellbore. At 804, the laser head emits a second laser beam. The second laser beam is emitted in a radial direction within the wellbore. The second laser beam is incident on a portion of the drill cuttings, causing the portion of the drill cuttings to consolidate and form a casing of the wellbore. At 806, while emitting the first and second laser beams, the drill cuttings are acoustically guided towards an inner wall of the wellbore.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous. Moreover, aspects described with reference to any figure or any implementation can be combined with aspects described with any other figure or any other implementation.

The invention claimed is:

1. A method of completing a wellbore, the method comprising:

rotating a wellbore drill bit through a subterranean zone to form a wellbore, wherein rotating the wellbore drill bit through the subterranean zone causes portions of the subterranean zone to be released as drill cuttings into the wellbore;

emitting, by a laser head attached to the wellbore drill bit, a laser beam that is incident on a portion of the drill cuttings, wherein the laser beam heats the portion of the drill cuttings to consolidate and form a casing of the wellbore mounting the laser head to be uphole relative to the wellbore drill bit;

mounting a separator member between the laser head and the wellbore drill bit; and guiding, by the separator member, the drill cuttings towards a path of the laser beam.

2. The method of claim 1, further comprising rotating the laser head with the wellbore drill bit while rotating the wellbore drill bit through the subterranean zone, wherein rotating the laser head heats the portion of the drill cuttings along an inner circumference of the wellbore.

3. The method of claim 1, wherein while emitting the laser beam on the portion of the drill cuttings causes the laser beam to exert a force on the portion of the drill cuttings to push the portion of the drill cuttings towards an inner wall of the wellbore before the laser beam heats the portion of the drill cuttings to consolidate and form the casing of the wellbore.

4. The method of claim 1, further comprising discharging, through a nozzle positioned near the wellbore drill bit, filler material to be heated by the laser beam and to be consolidated with the portion of the drill cuttings to form the casing of the wellbore.

5. The method of claim 4, further comprising flowing the filler material from a surface of the wellbore to the nozzle.

6. The method of claim 1, wherein emitting the laser beam comprises:

guiding a fiber-optic cable from a surface of the wellbore to the laser head; and transmitting the laser beam from the surface through the fiber-optic cable.

7. The method of claim 6, further comprising rotating the fiber-optic cable together with the wellbore drill bit and the laser head.

8. The method of claim 1, wherein the separator member comprises an adjustable arm and a curved plate, wherein guiding, by the separator member, the drill cuttings towards a path of the laser beam comprises adjusting a position of the adjustable arm or a position of the curved plate to direct the drill cuttings towards the path of the laser beam.

9. A wellbore completion comprising:

a wellbore drill bit configured to rotate and drill through a subterranean zone to form a wellbore, wherein, while rotating and drilling through the subterranean zone, the wellbore drill bit is configured to release portions of the subterranean zone as drill cuttings into the wellbore;

a laser head attached to the wellbore drill bit, wherein the laser head is mounted uphole relative to the wellbore drill bit, the laser head configured to emit a laser beam that, when incident on a portion of the drill cuttings, heats the portion of the drill cuttings to consolidate and form a casing of the wellbore; and a separator member mounted between the laser head and the wellbore drill bit, the separator member configured to guide the drill cuttings towards a path of the laser beam.

10. The wellbore completion of claim 9, wherein the laser head is configured to rotate with the wellbore drill bit to heat drill cuttings along an inner circumference of the wellbore.

11. The wellbore completion of claim 9, wherein the laser head is configured to exert a force on the portion of the drill cuttings to push the portion of the drill cuttings towards an inner wall of the wellbore before being heated by the laser beam to consolidate and form the casing of the wellbore.

12. The wellbore completion of claim 9, further comprising a plurality of nozzles mounted to the laser head, wherein the plurality of nozzles are configured to flow filler material to be heated by the laser beam and to be consolidated with the portion of the drill cuttings to form the casing of the wellbore.

13. The wellbore completion of claim 12, further comprising a flow pathway from a surface of the wellbore to the plurality of nozzles, the flow pathway configured to flow the filler material from the surface of the wellbore.

14. The wellbore completion of claim 9, further comprising a plurality of fiber-optic cables, each extending from a surface of the wellbore to the laser head, each configured to transmit the laser beam from the surface of the wellbore.

15. The wellbore completion of claim 9, wherein the separator member comprises an adjustable arm and a curved plate, each adjustable to direct the drill cuttings towards the path of the laser beam.

16. A method of completing a wellbore, the method comprising:

rotating, by a wellbore drilling assembly, a wellbore drill bit through a subterranean zone to form a wellbore, wherein rotating the wellbore drill bit through the subterranean zone causes portions of the subterranean zone to be released as drill cuttings into the wellbore, wherein a laser head is attached uphole relative to the wellbore drill bit, wherein the laser head is configured to emit a laser beam;

guiding, by a separator member mounted between the laser head and the wellbore drill bit, the drill cuttings towards an inner wall of the wellbore; and heating, by the laser beam emitted from the laser head, the drill cuttings pushed to the inner wall of the wellbore by a force exerted by the laser beam, wherein the heating melts the drill cuttings and forms a casing on the inner wall of the wellbore.

* * * * *